United States Patent [19]

Smith et al.

[11] Patent Number: 5,062,603

[45] Date of Patent: Nov. 5, 1991

[54] VACUUM DRUM PURGE METHOD AND APPARATUS

[75] Inventors: David A. Smith, Midland; James A. LaCombe, Bay City, both of Mich.

[73] Assignee: Dow Brands Inc., Indianapolis, Ind.

[21] Appl. No.: 514,464

[22] Filed: Apr. 25, 1990

[51] Int. Cl.[5] ..... B65H 5/22

[52] U.S. Cl. ..... 271/195; 271/108; 271/196

[58] Field of Search ..... 271/108, 194, 195, 196

[56] References Cited

U.S. PATENT DOCUMENTS

| | | | |
|---|---|---|---|
| 3,822,008 | 7/1974 | Benner | 271/108 X |
| 4,145,040 | 3/1979 | Huber | 271/196 X |
| 4,440,388 | 4/1984 | Divoux | 271/196 X |
| 4,464,219 | 8/1984 | Colombo . | |
| 4,583,729 | 4/1986 | Blumle | 271/108 X |

*Primary Examiner*—Richard A. Schacher

[57] ABSTRACT

A method and apparatus for supplying gas to a vacuum drum device and which substantially reduces or eliminates the problem of particle and debris buildup in the vacuum passages of the device is provided. The apparatus supplies gas, preferably at a pressure greater than atmospheric pressure, to the vacuum ports of a vacuum drum and includes a source of vacuum, a source of gas, and a rotatable vacuum drum. The drum includes a plurality of vacuum ports on the surface thereof, with the vacuum ports communicating with a plurality of vacuum passages extending generally outwardly from the interior of the drum. A valve alternately connects the passages to the vacuum source and to the source of gas. The selective exposure of the vacuum ports to either a source of vacuum or a source of gas prevents smoke, particles, and other contaminants from being drawn into the vacuum passages of the drum during operation of the system.

13 Claims, 5 Drawing Sheets

46
44a
75
77
82
74
76
44b
44
73
72
40
50
43
42
28

VACUUM DRUM PURGE METHOD AND APPARATUS

BACKGROUND OF THE INVENTION

This invention relates to a method and apparatus for supplying gas, preferably under pressure, to a vacuum drum device for maintaining the passages thereof clear from blockages, and more particularly to a method and apparatus for supplying gas to the vacuum ports of a rotating vacuum drum in an apparatus for the manufacture of plastic bags or containers.

In the production of individual flexible web products such as plastic containers and bags, the bag stock is typically supplied in the form of a continuous web of thermoplastic material which has been folded upon itself to form two plies. In forming individual bags, portions of the thermoplastic material, such as polyethylene, are severed from the web. These severed areas become side seams for the bags and are typically sealed at the same time as they are severed by the use of a heated wire element. The bags are then stacked, counted, and packaged by packing equipment.

The severing and sealing operation typically takes place on a relatively large diameter rotating product drum which may contain multiple heated wire severing and sealing elements positioned in grooves located within the outer periphery of the drum. As the drum rotates, different severing and sealing elements are actuated to raise them up to the drum surface to sever and seal a respective portion of the bag stock web which is secured to the drum surface by seal bar assemblies. The individual bags are retained on the product drum by a vacuum arrangement as the drum rotates.

Typically, the vacuum arrangement includes a number of surface vacuum ports which communicate with a source of vacuum. As the individual bags are formed from the continuous web, a spacing between successive bags is created resulting from the melt back of the thermoplastic web material as the side seams are severed and sealed by the heated wire element. During the severing and sealing operation, some smoke and particles are formed from the melted plastic and from the degradation products of the melted plastic. Additionally, long, thin filaments (angel hair) of plastic may be formed as the seal bar assemblies are pulled away from the drum surface. The still soft plastic bead formed by the severing and sealing operation may tend to stick to the seal bar assemblies and be drawn to form the plastic filaments.

Individual bags are then taken from the drum, stacked, and packaged. Presently, individual bags are taken from the drum by a smaller transfer drum, also suitably equipped with vacuum capabilities, including surface vacuum ports. The vacuum on the bags on the large drum is relieved at an appropriate point, and the bags fall onto the smaller drum where they are held in position by vacuum. At an appropriate point, the vacuum is released and the individual bags are pulled off the smaller drum by an orbital packer or similar device.

Because of the vacuum being pulled at ports located on the surfaces of the product and transfer drums, smoke, particles, filaments, and other contaminants from the severing and sealing of the individual bags are drawn into the ports where the particles become lodged on the surfaces of the vacuum ports and vacuum passages to form a waxy solid. Over time, the waxy buildup constricts the vacuum ports and passages and leads to misalignment problems with the bags on the drums as insufficient vacuums are applied to the bags. The misalignment of the bags in turn may lead to stacking and packaging problems and equipment jams. Additionally, some of the contaminants may be drawn through the vacuum passages and into the vacuum pump equipment causing maintenance problems there.

Periodically, the equipment must be shut down entirely, and a time-consuming and laborious cleaning and maintenance of the drum vacuum ports and passages must be carried out. The drums must be taken apart and the passages cleaned using scraping devices and solvents. This is expensive not only from the standpoint of labor, but also because of lost production due to the down time of the equipment.

In the past, changes to the construction of the bag making equipment have been made to improve access to the vacuum passages and ports in the drums. While making disassembly and cleanup of the drums easier, these changes did not address the problem of wax buildup. Additionally, manual intermittent air blasts have been used after shutting down the equipment in an attempt to blow accumulated particles from the vacuum passages of the transfer drum. This was not found to be very effective in dislodging the waxy particles which adhere to the vacuum passage walls. Again, the problem of the building up of accumulated particles and debris was not addressed.

Accordingly, the need still exists in this art for a method and apparatus which substantially reduces or eliminates the problems of waxy solid particle buildup in the vacuum passages of plastic bag making equipment and maintains those passages clear from blockages.

SUMMARY OF THE INVENTION

The present invention meets that need by providing a method and apparatus for supplying gas, preferably under a slight positive pressure, to a vacuum drum device and which substantially reduces or eliminates the problem of particle and debris buildup in the vacuum passages of the device. The method and apparatus of the present invention may find particular use in the field of manufacturing individual thermoplastic bags and containers from a continuous web of thermoplastic material such as polyethylene.

In accordance with one aspect of the present invention, apparatus for supplying gas to the vacuum ports of a vacuum drum is provided and includes a source of vacuum and a source of gas, and a vacuum drum, including means for rotating the drum. The source of gas is preferably under a positive pressure (i.e., greater than atmospheric). The drum includes a plurality of vacuum ports on the surface thereof, with the vacuum ports communicating with means for selectively exposing the vacuum ports to the vacuum source and the source of gas as the drum rotates.

This selective exposure of the vacuum ports to either a source of vacuum or a source of gas prevents the situation where uncovered ports draw smoke, particles, and other contaminants into the vacuum passages of a product or transfer drum. In the past, this has been the source of the particulate solid buildup in the passages of such drums. By selectively providing a source of preferably clean, filtered, gas to these passages during those periods when no vacuum is needed, smoke and particles are prevented from entering the vacuum passages. In a preferred form of the invention, the application of slight excess positive pressure gas flow out of the vacuum ports also provides clean filtered gas in the areas near the vacuum ports so that when a vacuum is again pulled, the gas in the area adjacent the vacuum ports is cleaner than it would be in the absence of the positive pressure purge gas.

In a preferred embodiment of the invention, the exposing means comprise a plurality of vacuum passages extending generally outwardly from the interior of the drum. Each of the passages is connected with a corresponding vacuum port. The exposing means also includes valve means for alternately connecting the passages to the vacuum source and to the source of gas. The exposing means preferably includes a manifold having at least one portion which communicates with the vacuum source and at least one portion which communicates with the source of gas.

The valve means is positioned so that it divides the first portion of the manifold from the second portion. In a preferred embodiment of the invention, the valve is a C-shaped plate positioned within the manifold. Rotation of the drum results in the valve alternately connecting the vacuum passages to the source of vacuum and the source of gas. The valve means further preferably includes at least one adjustable plug having a width equal to or greater than the diameter of the vacuum passages. In an alternative embodiment, the valve means comprises a fixed land area separating the first portion of the manifold from the second portion of the manifold. Again, the land area is equal to or greater than the diameter of the vacuum passages. Most preferably, the valve means comprises two adjustable plugs positioned within the manifold, and the manifold comprises at least two separate sections and is adapted to be removable from the drum.

In another embodiment of the invention, the exposing means comprise a plurality of vacuum passages extending generally outwardly from the interior of the drum with each of the passages connected with a corresponding vacuum port. A first manifold communicates with the vacuum source and a second manifold communicates with the source of gas. The second manifold comprises first and second sections, with the first section positioned adjacent a first end of the first manifold and the second section positioned adjacent the opposite end of the first manifold.

The present invention also includes a method for purging the vacuum ports of a vacuum drum which includes the steps of rotating the vacuum drum which has a plurality of the vacuum ports on the surface thereof, followed by exposing the vacuum ports to a source of vacuum for at least a portion of the rotation of the drum, and continuously exposing the vacuum ports to a source of gas for the remainder of the rotation of the drum. Preferably, the source of gas is under a positive pressure greater than atmospheric pressure, although gas at any pressure greater than that in the vacuum passages is useful. The method of the present invention is applicable to both a product drum on which individual flexible products are made as well as a transfer drum for transferring the flexible products from the product drum to packing equipment.

In one embodiment, the vacuum drum is a transfer drum for transferring individual flexible web products from a rotating product drum to a delivery point. The method includes the steps of exposing the vacuum ports to the source of vacuum from the point at which the individual flexible web products are transferred to the drum to the delivery point, and exposing the vacuum ports to the source of gas from the delivery point to a point just prior to the transfer of the individual flexible products onto the transfer drum.

In the other embodiment, the vacuum drum is a product drum for forming individual flexible products from a continuous web of flexible material supplied onto the surface of the drum. The method includes the steps of exposing the vacuum ports to the source of gas from a point during the transfer of the individual flexible products to a transfer drum to a point after the continuous web has been severed and sealed.

In still another embodiment of the invention, a method for purging the vacuum ports of a vacuum drum is provided which includes the steps of rotating the vacuum drum having a plurality of the vacuum ports on the surface thereof, exposing the vacuum ports to a source of vacuum for at least a portion of the rotation of the drum, and exposing the vacuum ports to a source of gas for at least a portion of the nonvacuum part of the rotation cycle of the drum. Preferably, the exposure takes place immediately prior to and/or immediately after exposing the ports to the source of vacuum. In this embodiment, the vacuum drum is a transfer drum for transferring individual flexible web products from a rotating product drum to a delivery point. The method includes the steps of exposing the vacuum ports to the source of vacuum from the point at which the individual flexible web products are transferred to the drum to the delivery point, and exposing the vacuum ports to the source of gas for at least a portion of the nonvacuum part of the rotation cycle of the drum. This preferably occurs immediately after the delivery point and just prior to the transfer of the individual flexible products onto the transfer drum.

By providing a source of clean, filtered gas such as air to the vacuum ports on a vacuum drum device for that portion of its rotation where the ports are exposed to an environment containing smoke, particles, and other environmental contaminants, the vacuum passages and ports remain free of the matter which heretofore accumulated and built up in those passages. Further, the preferred use of positive pressure gas in the vacuum passages provides the added benefit of speeding up vacuum release by filling the passages more quickly with gas. Additionally, because the passages are filled with clean gas during those portions of the cycle when no vacuum is needed, only clean gas is pulled into the vacuum pumping equipment when a vacuum is needed.

Accordingly, it is an object of the present invention to provide a method and apparatus which substantially reduces or eliminates the problems of waxy solid particle buildup in the vacuum passages of plastic bag making equipment and maintains those passages clear from blockages. This, and other objects and advantages of the present invention, will become apparent from the following detailed description, the accompanying drawings, and the appended claims.

DETAILED DESCRIPTION OF THE PREFERRED EMBODIMENTS

Figure 1:
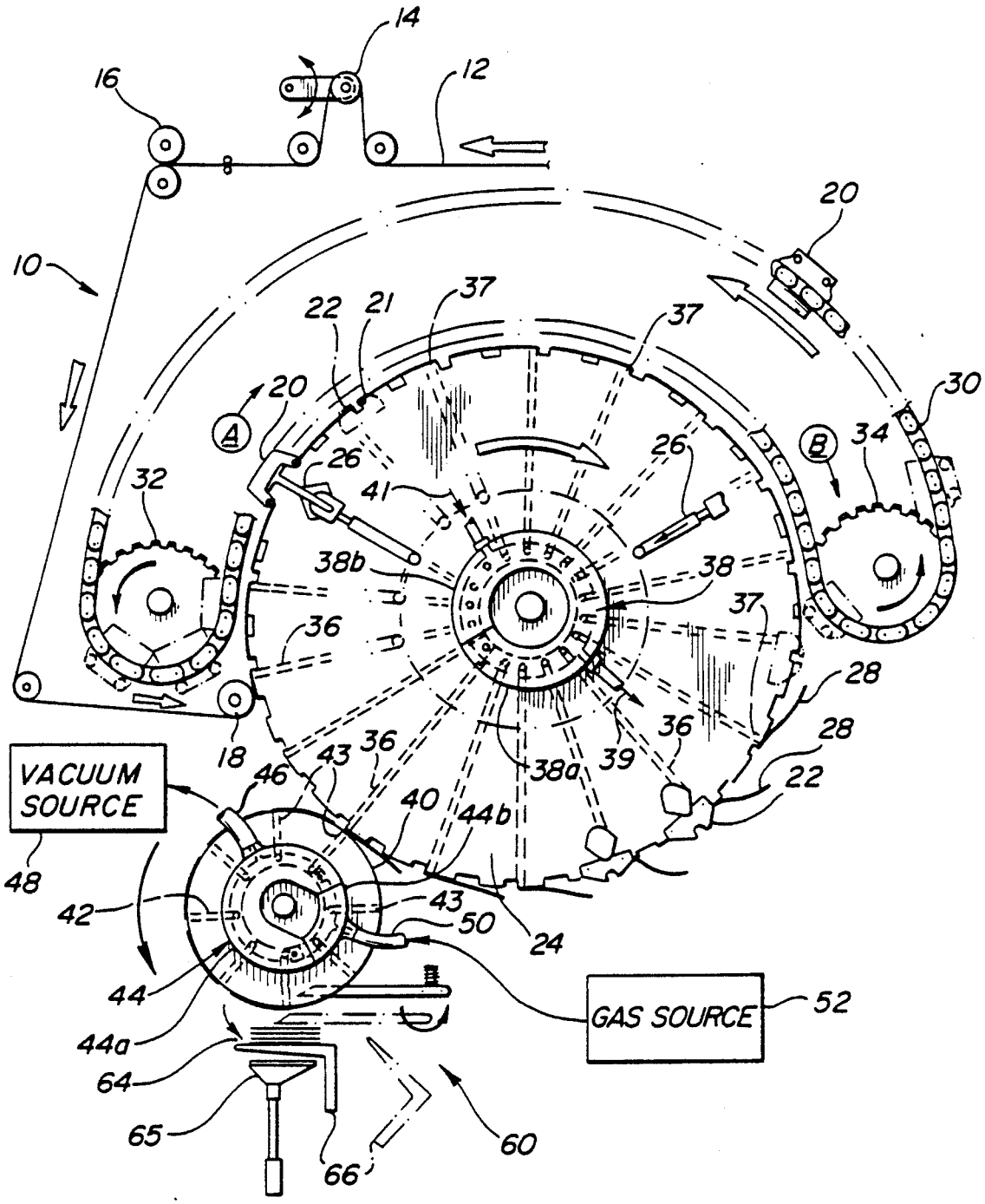
FIG. 1 is a schematic side elevational view of one embodiment of the apparatus of the present invention.

Referring now to FIG. 1, the apparatus of the present invention is illustrated in schematic form. The apparatus, generally indicated at 10, receives a continuous web, designated film web 12, from a spool (not shown) or directly from an extrusion line. While the invention will be described in the context of a web of thermoplastic material such as polyethylene used to form individual plastic bags or containers, it will be apparent to those skilled in the art that the apparatus of the present invention is applicable to other products which are fed from a continuous web and then divided into individual flexible products.

Film web 12 may either be a zippered or unzippered bag stock being folded on itself to provide a two ply film. Film web 12 is caused to pass over dancer roll 14 which acts to control film web tension based on its vertical positioning. Film web 12 is then pulled through a draw roll arrangement 16 which is driven at a speed slightly in excess of the rotational speed of product drum 44. This type of operation permits some slack in the film as it is being fed onto vacuum product drum 24. Vacuum product drum 24 is driven by drive means (not shown) in a conventional manner. The film web 12 then passes over a lay-on roll 18 which is located to position the film web accurately against the rotating product drum surface.

Film web 12 is then severed and sealed on product drum 24 in the following manner. Film web 12 is clamped tightly to the outer surface of product drum 24 at a severing and sealing edge of a heating element slot 21 by seal bar assembly 20. Seal bar assembly 20 is aligned in proper position through the use of locating plates or yokes 22 on the product drum 24. As product drum 24 rotates in the direction of the arrow, a heated wire severing and sealing element, shown generally at 26, operable through a cam assembly (not shown), emerges from a recess in product drum 24 and severs film web 12 at position A.

The severing and sealing element remains extended for approximately 120 degrees of rotation of the product drum until the severing and sealing element 26 is withdrawn as shown schematically at position B. During the time that the element is extended, the film melts back to the edge of the seal bar assembly 20 and a bead seal forms on the edge of the bag. Individual bags 28 are formed by the severing and sealing of the film web on adjacent seal bar assemblies.

Just prior to the release of the clamping force of the seal bar assembly 20, a vacuum is applied to the leading edge of individual bags 28. Seal bar assembly 20 is removed from the product drum by a continuous chain drive 30 having sprockets 32 and 34 located on opposite sides of product drum 24. The chain drive 30 and locating plates 22 permit precise positioning of the individual seal bar assemblies 20 along the surface of the product drum.

Individual bags 28 are held in position on rotating product drum 20 by respective vacuum ports 37 on the drum surface which communicate through vacuum passages 36 with manifold 38. Manifold 38 in turn communicates with a vacuum source 48 through line 39 and a source of a low positive pressure gas such as air 52 through line 41. Manifold 38 is preferably in two parts, **38*a* and 38*b***.

Portion **38*a* communicates with the vacuum source, while portion 38*b* communicates with the source of positive pressure gas. As best shown in the embodiment illustrated in FIG. 5, land areas 90, 92** separate the manifold portions from each other. The land areas have a width which is equal to, and preferably slightly greater than the diameter of the vacuum passages. In this manner, as the drum rotates and the passages are switched from vacuum to positive pressure air, there is no time at which an individual passage is simultaneously exposed both to vacuum and positive pressure gas.

The source of gas may be any suitable source of clean filtered air or other gas which is readily available in a plant. Alternatively, the gas may be brought in from outside of the plant through a filtering system. Any source of clean gas at a pressure greater than that in the vacuum passages is useful as that gas will flow into the vacuum passages once the vacuum is removed. However, low positive pressure gas at a pressure slightly in excess of atmospheric pressure is preferred as that gas will fill the vacuum passages quickly.

Figure 5:
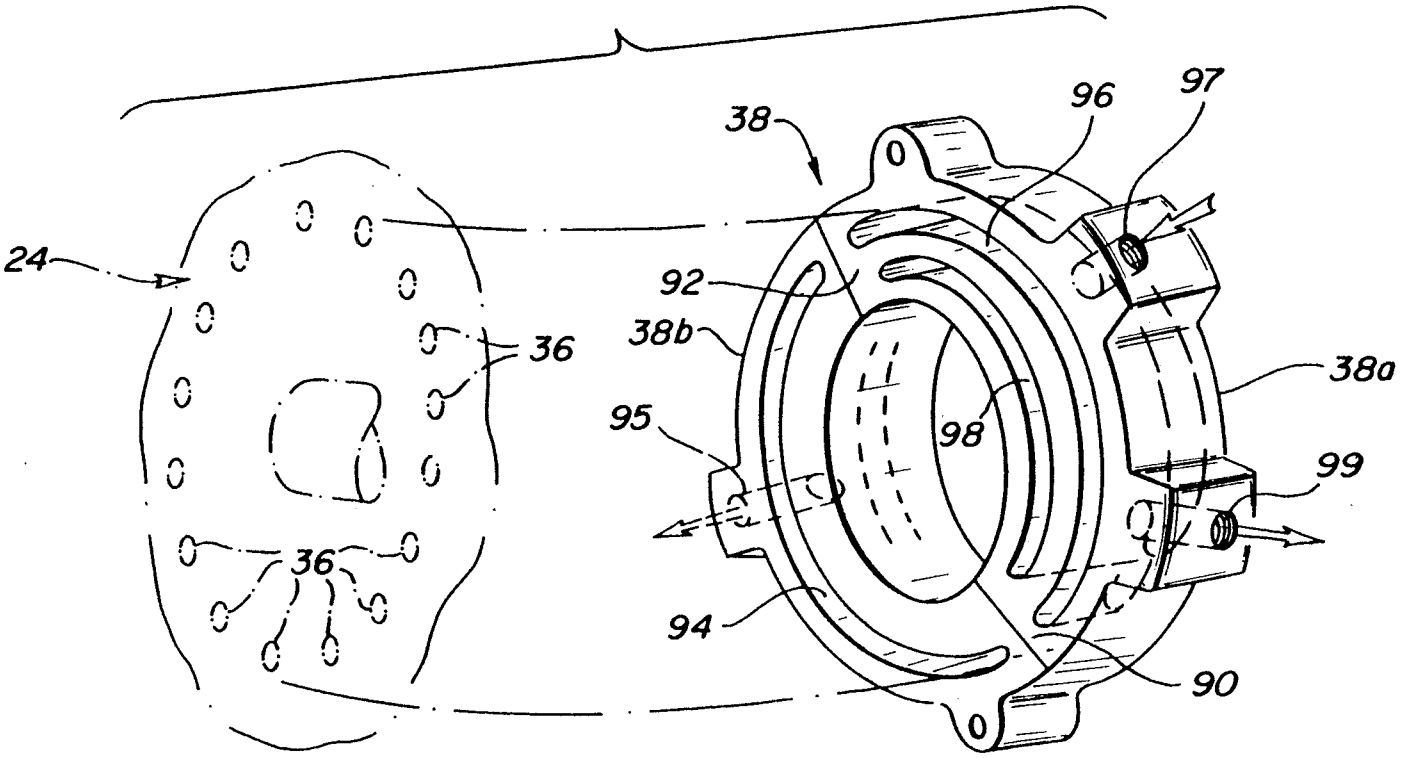
FIG. 5 is an exploded perspective view of one embodiment of the manifold which may be used on the product drum.

In the embodiment shown in FIG. 5, the valve arrangement includes a semicircular-shaped channel 94 which communicates with vacuum passages 36 and vacuum source 48, through passage 95, during that portion of the rotation of product drum 24 in which a vacuum is applied to the bags 28 to maintain them in position on the surface of the product drum. As drum 24 rotates around to the bag pick-off point along the tangent between drums 24 and 40, the vacuum is released as passages 36 pass beneath land area 90. Land area 90 may also be replaced by an adjustable plug such as plugs 72, 73 shown in FIG. 3.

Clean, filtered air, preferably under a positive pressure, then floods the passages 36 as they come into communication with semicircular-shaped channel 96. Channel 96 communicates with gas source 52 through passage 97. In the embodiment illustrated in FIG. 5, an optional channel 98 is positioned inwardly of channel 96, but does not communicate with it. Channel 98 is in communication with vacuum source 48 through passage 99. The vacuum applied in channel 98 acts to pull the manifold against the end of drum 24 to maintain a good seal and to counteract any tendency for the positive air pressure in channel 96 to cause the manifold to "float" away from the end of drum 24 and cause uneven wear on the inner surfaces of the manifold. Alternatively, any suitable mechanical means such as springs, air cylinders, hydraulic cylinders, or the like may be used to counteract any tendency of the manifold to "float" away from the drum surface.

Referring back to FIG. 1, as product drum 24 rotates, vacuum ports 37 are brought into and out of communication with manifold 38. This construction causes a vacuum to be applied to the leading edges of bags 28 beginning at a point just prior to the removal of seal bar assembly 20, approximately at position B, until just prior to transfer to transfer drum 40. It will be appreciated that each vacuum passage 36 is in communication with a plurality of vacuum ports 37 in an array across the surface of the drum.

For the remainder of the rotation of the drum, the vacuum passages 36 and ports 37 are in communication with gas source 52 through line 41. Preferably, the pressure of the gas is sufficient only to provide a small net positive flow of gas from the vacuum ports, but insufficient to cause the film web 12 to "float" from the drum surface or to interfere with the clamping of the web to the drum surface for severing and sealing. It has been found that a low net positive pressure on the order of only 1–10 inches of water above atmospheric pressure is preferable. Again, any source of clean gas at a pressure greater than the vacuum in the passages is useful, although gas at a pressure slightly greater than atmospheric is preferred.

Bags 28 are held onto rotating transfer drum 40 by a similar vacuum system. A set of vacuum ports 43 on the surface of the drum communicate with manifold 44 through vacuum passages 42. Again, each vacuum passage 42 communicates with a plurality of vacuum ports 43 in an array across the drum surface. Manifold 44 in turn communicates with a vacuum source 48 and a source of low positive pressure gas 52. Manifold 44 is in two separate parts, with portion **44*a* communicating, through line 46, to vacuum source 48, and portion 44*b* communicating, through line 50 to gas source 52. As shown, at a point approximately along a line between the centers of product drum 24 and transfer drum 40, the vacuum is relieved from product drum 24. Gravity then causes the bags 28 to fall toward drum 40 where a corresponding vacuum port 42** is activated.

Vacuum ports 43 on transfer drum 40 are positioned so that each individual bag 28 is removed from the product drum 24. As shown, each set of vacuum ports is in communication with vacuum source 48 during rotation of transfer drum 40 until a point approximately where packing device 60 removes the bags from the drum. As bags 28 are brought around transfer drum 40, the bags secured by vacuum ports 43 hold onto the bags until they reach a nearly horizontal position where the vacuum is released.

In packing device 60, orbital packer fingers 62 pull the individual bags away from the drum surface and deposit the bags into a stack 64 on delivery table 65. At a precise time, count fingers 66 pivot between the position shown in phantom lines completely out of the stream of bags into the position shown to separate the stack 64 of bags into the desired count. The delivery table 65 may be lowered to permit a clamp assembly (not shown) to clamp the stack of bags and transfer it to further conventional equipment for packaging the bags.

Figure 2:
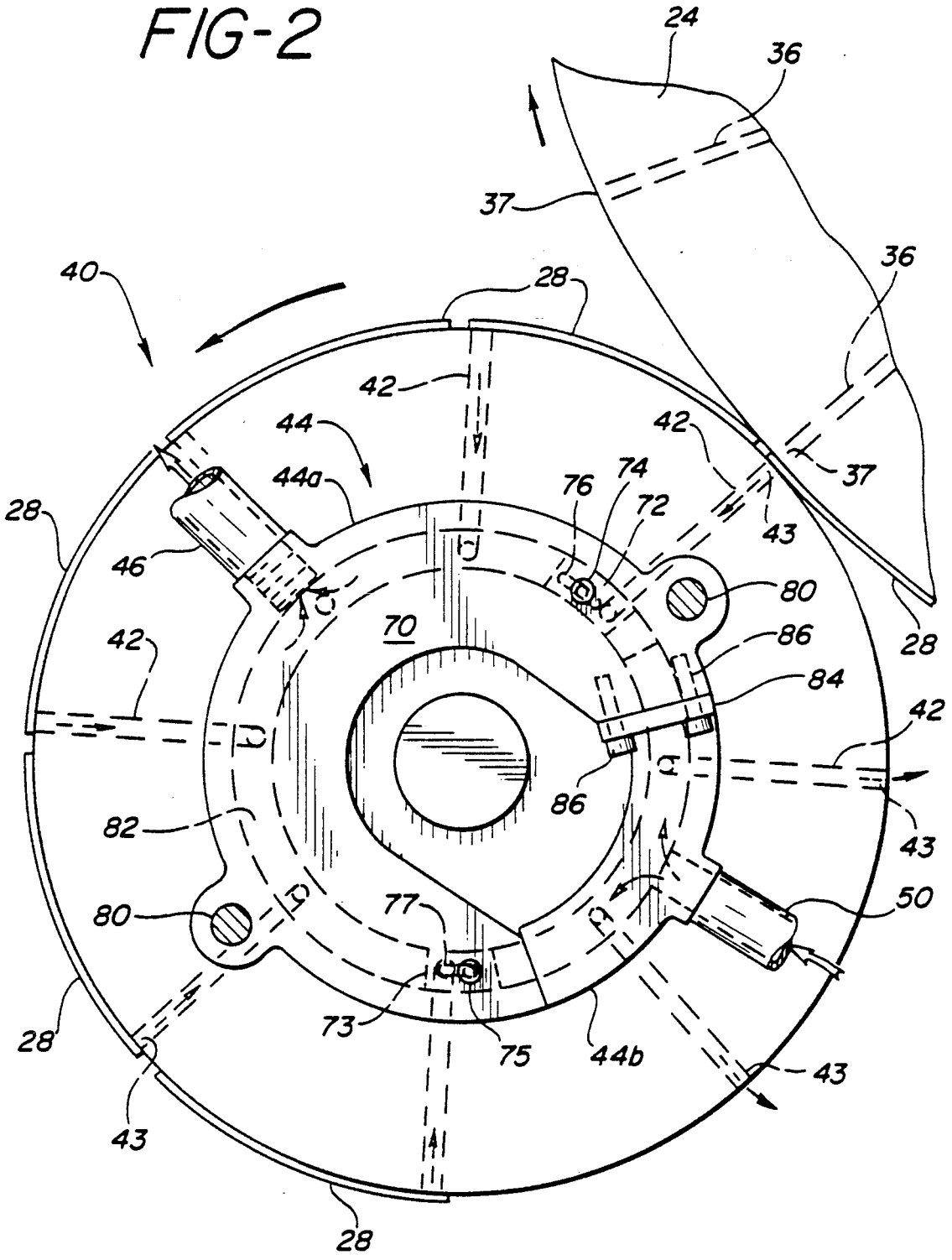
FIG. 2 is an enlarged side elevational view of a transfer drum equipped with the vacuum and positive pressure manifolds of the present invention.
Figure 3:
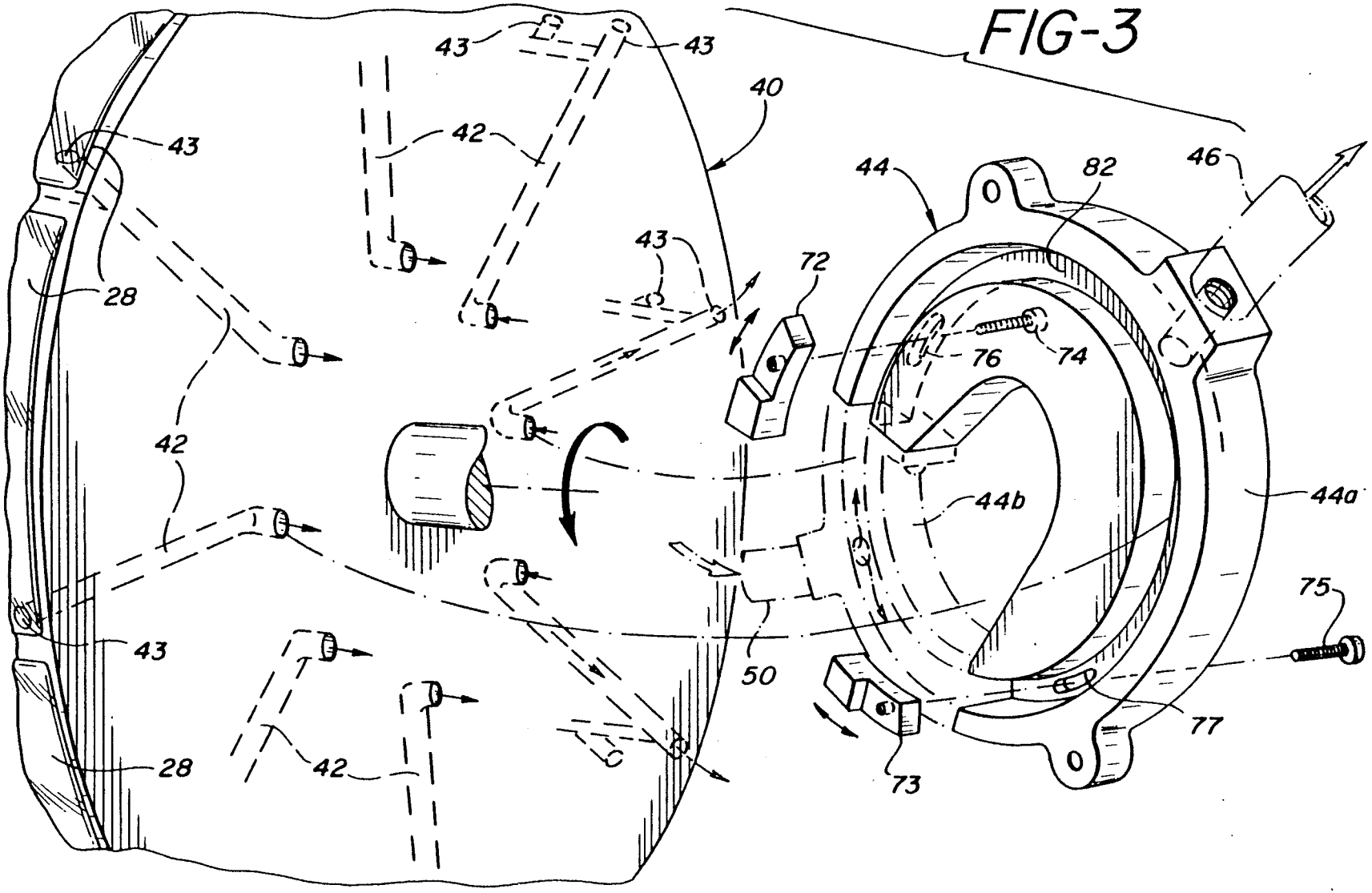
FIG. 3 is an exploded perspective view of the end of the transfer drum, the manifolds, and the valves used in one embodiment of the present invention.

Referring now to FIGS. 2 and 3, the manifold and valve arrangement for transfer drum 40 is shown in greater detail. As can be seen, manifold 44 is secured to the end of transfer drum 40 by suitable means such as bolts 80. Manifold 44 is shown as having two portions, **44*a* and 44*b*, which are secured together by suitable means such as flange 84 and bolts 86. Within manifold 44 is a channel 82 which communicates with vacuum passages 42 as well as lines 46 and 50 which communicate with vacuum source 48 and gas source 52**, respectively.

Located within channel 82 are valve means 70. In the preferred embodiment of the invention illustrated in FIGS. 2 and 3, valve means 70 comprises a C-shaped plate about which channel 82 extends. In channel 82, two adjustable plugs 72, 73 are secured within elongated slots 76, 77 by suitable means such as screws 74, 75. The screws may be loosened, and the positioning of the plugs may be adjusted as needed so that the switch from vacuum to positive pressure gas occurs at the desired location.

Figure 4:
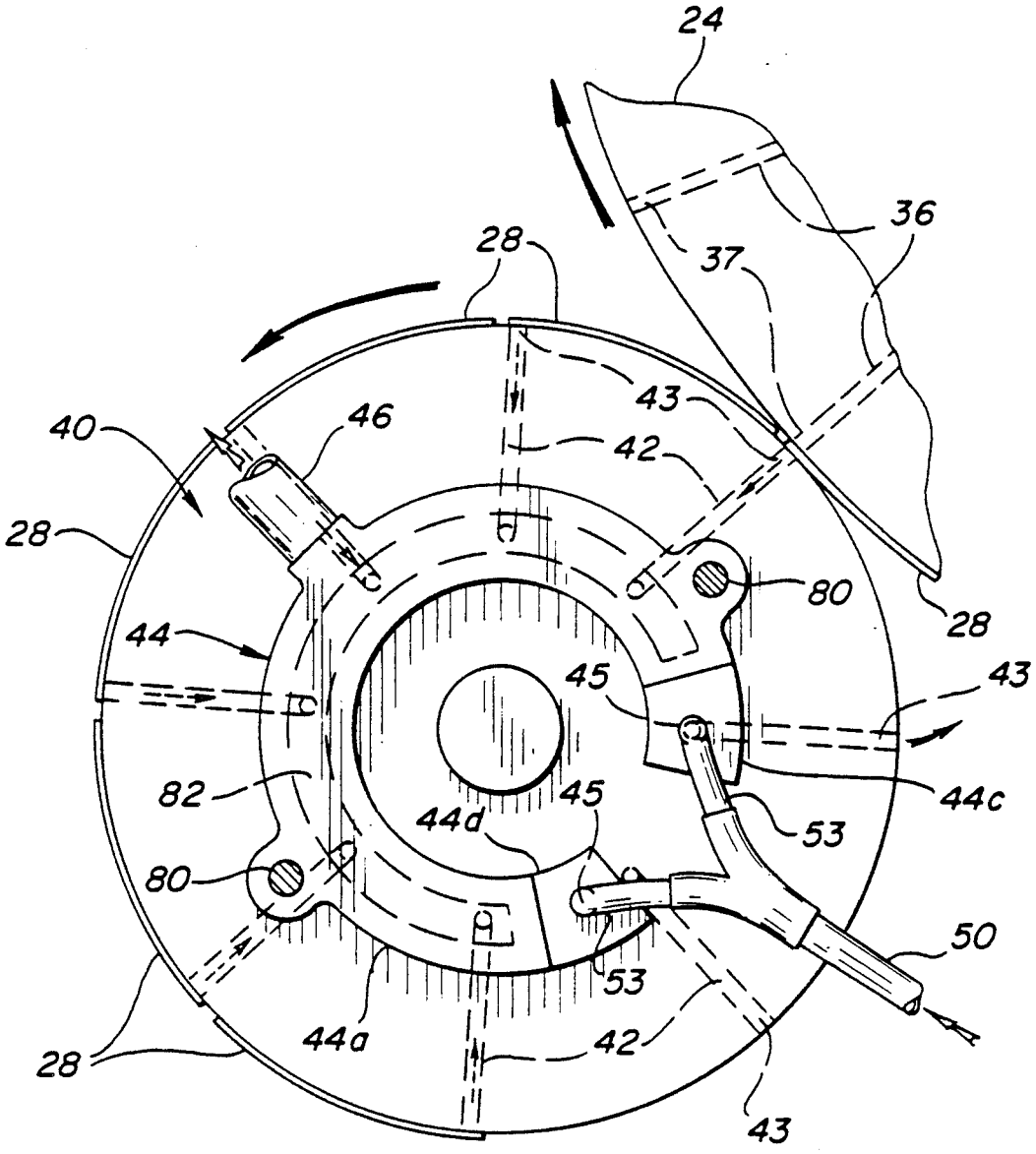
FIG. 4 is an enlarged side elevational view of a transfer drum equipped with an alternative embodiment of the vacuum and positive pressure manifolds of the present invention.

An alternative embodiment of the invention is illustrated in FIG. 4, where like elements are indicated by like reference numerals. In this embodiment of the invention, gas is supplied to vacuum passages 42 immediately prior to and immediately after the passages have been exposed to vacuum source 48. In this manner, clean, filtered gas is supplied within the vacuum passages during those critical periods where smoke and other contaminants would otherwise be free to enter those passages. When the passages are exposed to vacuum, the clean gas in the passages will be pulled through them, not smoke-filled air. Gas supplied to the passages at any time during the nonvacuum portion of the rotation cycle of the drum is useful.

As shown in FIG. 4, two manifold segments **44*c* and 44*d* are provided and supplied with clean, filtered gas through lines 50, 53 from gas source 52. The land areas on the manifold segments have a width at least equal to the diameter of the vacuum ports 43** so that no port is ever in contact simultaneously with vacuum and a source of gas.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. Apparatus for supplying gas to the vacuum ports of a vacuum drum comprising:

a source of vacuum and a source of gas;

a vacuum drum, including means for rotating said drum;

said drum including a plurality of vacuum ports on the surface thereof, said vacuum ports communicating with means for selectively exposing said vacuum ports to said vacuum source and said source of gas as said drum rotates, said exposing means comprising a plurality of vacuum passages each having a diameter and extending generally outwardly from the interior of said drum, each of said passages connected with a corresponding vacuum port; and valve means for alternately connecting said passages to said vacuum source and to said source of gas, said valve means comprising a channel including at least one adjustable plug positioned in said channel, said plug having a width equal to or greater than the diameter of said vacuum passages.

2. The apparatus of claim 1 in which said source of gas is at a pressure greater than atmospheric pressure.

3. The apparatus of claim 1 in which said valve means comprises two of said adjustable plugs positioned within said manifold.

4. The apparatus of claim 1 in which said exposing means comprise a plurality of vacuum passages extending generally outwardly from the interior of said drum, each of said passages connected with a corresponding vacuum port, and a first manifold communicating with said vacuum source and a second manifold communicating with said source of gas.

5. The apparatus of claim 4 in which said second manifold comprises first and second sections, said first section positioned adjacent a first end of said first manifold and said second section positioned adjacent the opposite end of said first manifold.

6. The apparatus of claim 1 including means for communicating with said vacuum source to seal said manifold to the end of said vacuum drum.

7. The apparatus of claim 6 in which said means for communicating with said vacuum source comprises a second channel in said valve means.

8. An apparatus for supplying gas to the vacuum ports of a vacuum drum comprising:

a source of vacuum and a source of gas;

a vacuum drum, including means for rotating said drum;

said drum including a plurality of vacuum ports on the surface thereof, said vacuum ports communicating with means for selectively exposing said vacuum ports to said vacuum source and said source of gas as said drum rotates, said exposing means including a manifold having at least a first portion which communicates with said vacuum source and at least a second portion which communicates with said source of gas; and valve means dividing said first portion of said manifold from said second portion, said valve means comprising a fixed land area separating said first portion of said manifold from said second portion of said manifold.

9. The apparatus of claim 8 in which said manifold comprises at least two separate sections and is adapted to be removable from said drum.

10. A method for purging the vacuum ports of a vacuum transfer drum for transferring individual flexible web products from a rotating product drum to a delivery point comprising the steps of:

rotating said vacuum drum having a plurality of said vacuum ports on the surface thereof;

exposing said vacuum ports to a source of vacuum from the point at which said individual flexible we products are transferred to said drum to said delivery point; and continuously exposing said vacuum ports to a source of gas from said delivery point to a point just prior to the transfer of said individual flexible products onto said transfer drum.

11. The method of claim 10 in which the gas is at a pressure greater than atmospheric pressure.

12. A method for purging the vacuum ports of a vacuum product drum for forming individual flexible products from a continuous web of flexible material supplied onto the surface of said drum, said method including the steps of:

rotating said vacuum drum having a plurality of said vacuum ports on the surface thereof;

exposing said vacuum ports to a source of vacuum for at least a portion of the rotation of said drum; and continuously exposing said vacuum ports to a source of gas for the remainder of the rotation of said drum from a point during the transfer of said individual flexible products to a transfer drum to a point after said continuous web has been severed and sealed.

13. A method for purging the vacuum ports of a vacuum drum which is a transfer drum for transferring individual flexible web products from a rotating product drum to a delivery point comprising the steps of:

rotating said vacuum drum having a plurality of said vacuum ports on the surface thereof;

exposing said vacuum ports to a source of vacuum from the point at which said individual flexible web products are transferred to said drum to said delivery point; and exposing said vacuum ports to a source of gas immediately after said delivery point and just prior to the transfer of said individual flexible products onto said transfer drum.

* * * * *